United States Patent [19]

Pawlowski

[11] 4,256,223

[45] Mar. 17, 1981

[54] DUAL COMPARTMENT DISPLAY CARTON

[75] Inventor: Thomas D. Pawlowski, Neenah, Wis.

[73] Assignee: American Can Company, Greenwich, Conn.

[21] Appl. No.: 75,250

[22] Filed: Sep. 13, 1979

[51] Int. Cl.[3] ..... B65D 5/46; B65D 25/54; B65D 25/28

[52] U.S. Cl. ..... 206/45.11; 206/192; 206/602; 206/141; 229/27; 229/52 B

[58] Field of Search ..... 206/45.11, 141, 192, 206/602, 45.31; 229/52 B, 27

[56] References Cited

U.S. PATENT DOCUMENTS

| | | | |
|---|---|---|---|
| 1,210,008 | 12/1916 | Singer et al. | 206/45.11 |
| 2,126,407 | 8/1938 | Payne et al. | 206/45.11 |
| 2,671,584 | 3/1954 | Taylor, Jr. | 206/45.11 |
| 3,677,458 | 7/1972 | Gosling | 206/192 |

*Primary Examiner*—William T. Dixson, Jr.
*Attorney, Agent, or Firm*—Robert P. Auber; Ira S. Dorman; Harry C. Engstrom

[57] ABSTRACT

A display carton (10) is disclosed having two compartments (12, 14) which are movable between a carrying and a display configuration. A display panel (28, 30) with a display window opening (22, 24) therein is provided on each of the compartments (12, 14) such that the display panels (28, 30) are exposed for viewing when the carton (10) is in its display configuration, but not when it is in its carrying configuration.

9 Claims, 4 Drawing Figures

DUAL COMPARTMENT DISPLAY CARTON

TECHNICAL FIELD

The present invention relates to paperboard cartons including provisions for displaying the contents therein, and, in particular, to such display cartons specifically intended to be carried by hand suspended from a handle.

BACKGROUND OF THE PRIOR ART

The prior art is generally cognizant of the use of cartons having display windows cut therein so that the contents of the carton may be viewed. The prior art is also generally cognizant of the use of cartons having carrying handles thereon so that the carton, with the contents therein, may be easily carried by hand by the consumer. At least one example is known, that embodied in U.S. Design Pat. No. D 248,123, of a carrying carton having a hinge provided therein so that two portions of the carton may pivot relative to each other to open the interior of the carton.

SUMMARY OF THE INVENTION

The present invention is summarized in that a display carton includes first and second display panels hinged together by a common scoreline, each of the display panels having a display window opening cut therein; a top panel joined to each of the display panels; a side panel joined to each of the top panels; a bottom panel joined to each of the side panels, each of the bottom panels also joined to the respective display panel thereby defining a first compartment by a one of the display panels, the top panels, the side panels and the bottom panels and a second compartment by the other of the display panels, the top panels, the side panels, and the bottom panels, the first and second compartments being joined hingedly together by the scoreline joining the display panels together, the compartments being pivotable relative to each other along the scoreline between a display position, in which the display panels are visible, and a carrying position, in which the display panels are held in abutting relation; and a pair of handles each of which is attached to a respective one of the compartments and positioned thereon so that the carton may be carried suspended from the handles when the compartments are pivoted to the carrying position.

It is an object of the present invention to construct a display carton which is pivotable between a display position and a carrying position.

It is another object of the present invention to provide such a display carton in which the contents of the carton are segregated into two compartments, and in which the contents of the two compartments are not displayed when the carton is pivoted to its carrying position.

It is another object of the present invention to provide such a carton pivotable between display and carrying positions, in which the weakest part of the carton, the display window, is not exposed on the exterior of the carton when the carton is in its carrying position.

Other objects, advantages, and features of the present invention will become apparent from the following specification, when taken in conjunction with the accompanying drawings.

DETAILED DESCRIPTION OF THE INVENTION

Figure 1:
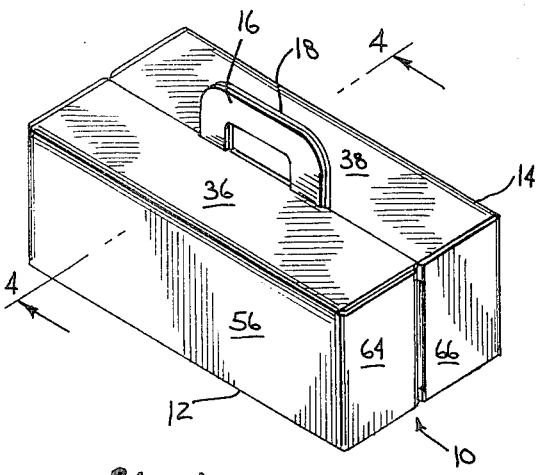
FIG. 1 is a perspective view of the display carton of the present invention in its carrying position.
Figure 2:
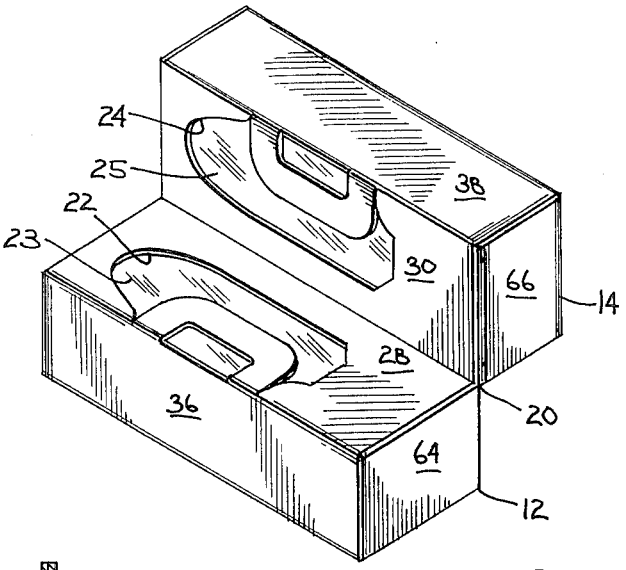
FIG. 2 is a perspective view of the display carton of the present invention in its display position.

Shown in FIG. 1 is a dual compartment display carton, generally indicated at 10, constructed in accordance with the present invention. The display carton 10 is shown in FIG. 1 in its carrying position with its two compartments 12 and 14 lying next to and against each other and suspended from a pair of handles 16 and 18. The display carton 10 may also be folded to a display position when it is not required that the carton be easily carried by hand. Thus, as shown in FIG. 2, the compartments 12 and 14 may be folded apart from each other along a scoreline hinge 20 lying joining the compartments 12 and 14 so that a pair of display windows 22 and 24 become visible to display to a viewer the contents within each of the compartments 12 and 14. When it is desired that the carton 10 again be ready for carrying, the compartments 12 and 14 may be folded together again and the handles 16 and 18 brought up to the positions as shown in FIG. 1.

Figure 3:
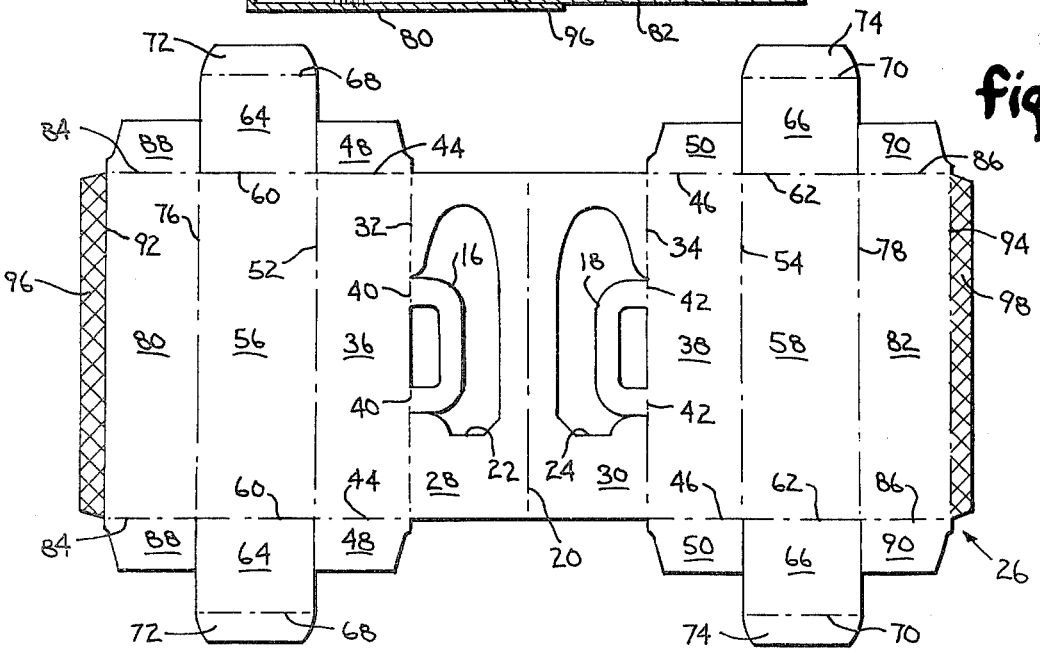
FIG. 3 is a plan view of a paperboard blank for use in constructing the display carton of FIGS. 1 and 2.

Shown in FIG. 3 is a paperboard blank, generally indicated at 26, suitable for constructing the dual compartment display carton 10. Centrally formed in the blank 26, which has its exterior side shown in FIG. 3, are a pair of display panels 28 and 30 which are joined together by the hinged scoreline 20. The display panels 28 and 30 have formed in them respective complementary display window openings 22 and 24. Each of the display panels 28 and 30 is formed in an elongated rectangular shape with the scoreline 20 forming one long side of the rectangle of each of the display panels 28 and 30. The other long side of each of the rectangles of the display panels 28 and 30 is defined by a respective one of a pair of scorelines 32 and 34 which join the display panels 28 and 30 to respective top panels 36 and 38. The top panels 36 and 38 are also formed as elongated rectangular panels having a length identical to that of the display panels 28 and 30. Extending from the top panels 36 and 38 into the area of the display windows 22 and 24 in each of the display panels 28 and 30 are the respective cut-out handles 16 and 18. The handles 16 and 18 are hinged by respective scorelines 40 and 42 to the top panels 36 and 38. The scorelines 40 and 42 are each co-linear with the respective scorelines 32 and 34. Attached to each of the shorter ends of the top panel 36 by respective scorelines 44 are a pair of tuck flaps 48. Similarly, scorelines 48 attach a pair of tuck flaps 50 to the opposite shorter ends of the top panel 38. The other long side of the rectangle of each of the top panels 36 and 38 is defined by a one of scorelines 52 and 54 which attach to the top panels 36 and 38 respective side panels 56 and 58. The side panels 56 and 58 are also formed as elongated rectangular panels equal in length to the display panels 28 and 30 and the top panels 36 and 38, and being equal in width to the display panels 28 and 30. At each of the ends of the rectangles of each of the side panels 56 and 58, respective scorelines 60 and 62 are formed to attach pairs of respective end flaps 64 and 66 to each of the ends of each of the side panels 56 and 58. Each of the end flaps 64 and 66 has formed on its outer edge respective scorelines 68 and 70 which attach a one of tuck tabs 72 and 74 to each of the end flaps 64 and 66. The other longer side of the rectangle of each of the side panels 56 and 58 is defined by a respective one of scorelines 76 and 78 which attach to each of the side panels 56 and 58 one of a pair of bottom panels 80 and 82. The bottom panels 80 and 82 are also formed as elongated rectangles having a length, or longer dimension, equal to that of the side panels 56 and 58, and a width, or shorter dimension, equal to that of the top panels 36 and 38. Each pair of the ends of the rectangles of the bottom panels 80 and 82 is defined by respective scorelines 84 and 86 which attach to the ends of the bottom panels 80 and 82 respective pairs of tuck flaps 88 and 90. The other longer side of the bottom flap 82 is defined by a scoreline 92 and 94 which attaches to that side of the respective bottom panels 80 and 82 and elongated glue flap 96 and 98. The glue flaps 96 and 98 are coextensive with the length of the adjoining bottom panels 80 and 82 which are coequal in length to the side panels 56 and 58. As indicated in FIG. 3, in preparation for the assembly of the carton 10 from the blank 26, the glue flaps 96 and 98 are preferably provided with glue thereon as indicated by the cross hatching in FIG. 3.

In assembling the carton 10 of FIGS. 1 and 2 from the blank of FIG. 3, it is first necessary to install a pair of transparent window sheets 23 and 25 onto the appropriate window panels 28 and 30 so as to provide a transparent covering over the respective window openings 22 and 24. The extreme edges of the window sheets 23 and 25 farthest from scoreline 20 are attached to the respective top panels 36 and 38 to insure that the transparent window sheets 23 and 25 extend over the full extent of the window openings 22 and 24. In attached the window sheets 23 and 25, care must be taken to insure that the handles 16 and 18 are not adhered to the respective window sheets 23 and 25.

Figure 4:
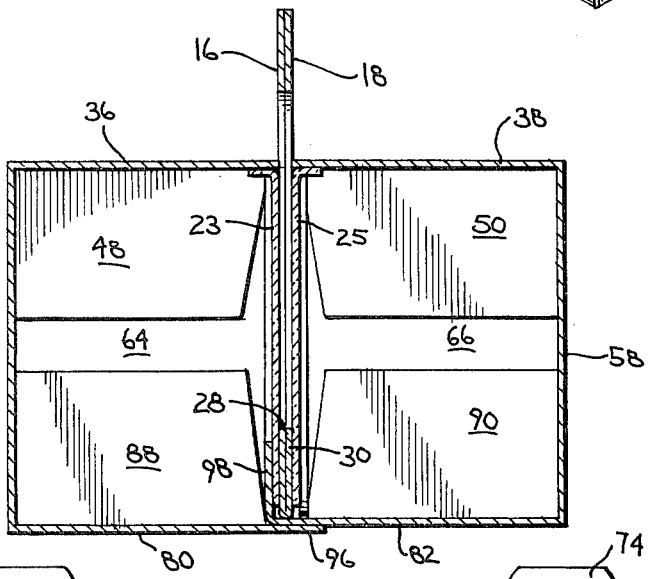
FIG. 4 is a cross-sectional view taken along the line 4—4 in FIG. 1.

In folding the blank 26 into the erected carton 10, it is first necessary to fold the blank 26 along the scoreline 20 so that the display panels 28 and 30 lie adjacent and facing each other. Then the compartment 14 is erected by folding the top panel 30 relative to the display panel 30 along the scoreline 34 until it is perpendicular thereto, and then folding the side panel 58 along the scoreline 54 until it is perpendicular to the top panel 38, and then folding the bottom panel 82 along the scoreline 78 until it is perpendicular to the side panel 58. At this point, the scoreline 94 attaching the glue flap 98 to the bottom panel 82, lies adjacent the scoreline 20, and the glue flap 98, having glue applied thereto, may be folded over along the scoreline 94 to adhere to the face of the display panel 28, as can be seen in cross-sectional view of FIG. 4. Following the erection of the compartment 14, the compartment 12 may be similarly erected by first folding the top panel 36 relative to the display panel 28 along the scoreline 32 until the top panel 36 is perpendicular to the display panel 28, followed by the folding of the side panel 56 relative to the top panel 36 along the scoreline 52 until it is perpendicular to the top panel 36, and followed in turn by the folding of the bottom panel 80 along the scoreline 76 until it is perpendicular to the side panel 56. This last fold brings the glue flap 96 against the exterior side of the bottom panel 82 adjacent to the scoreline 94 thereon, with the result that the glue flap 96 adheres to the exterior of the bottom panel 82 in a fashion as can be seen in the cross-sectional view of FIG. 4. The respective pairs of the tuck flaps 48 and 50 and 88 and 90 may then be folded along their respective scorelines into the open ends of the two compartments 12 and 14, and the pairs of the end flaps 64 and 66 may then also be folded over with the tuck tabs 72 and 74 being inserted inside of the respective display panels 38 and 30 to close the ends of the compartments 12 and 14. The end flaps 64 and 66 may be re-opened at any time so that contents may be inserted into the two compartments 12 and 14 of the carton 10.

An alternative closure (not shown) of the glue flaps 96 and 98 may be utilized where a somewhat simplified carton assembly operation is desired. In this alternative closure, the glue flap 98 is folded back 180° to lay on top of and be glued to the inward facing surface of the bottom panel 82. The glue flap 96 is then glued to the top surface of the glue flap 98, and the bottoms of the display panels 28 and 30 adjacent the scoreline 20 are thereafter glued to the top surface of the glue flap 96 to complete the carton. Other folding operations are accomplished in the same manner as described above.

As can be seen in FIGS. 1 and 2, the dual compartment display carton 10 is intended to be used in two distinct configurations. In its configuration as shown in FIG. 1, the carton 10 is designed to be a carrying carton in which two articles may be separately carried in the two compartments 12 and 14 by a common handle. By contrast, the configuration of the carton 10, as shown in FIG. 2, is one designed to display the contents of the interior of the compartments 12 and 14 to a viewer, such as is normally desired in a commercial retail situation in which shoppers are viewing the merchandise displayed for sale. It is also envisioned that the compartments 12 and 14 may be further rotated along the scoreline 20, beyond that configuration shown in FIG. 2, until the display panels 28 and 30 are coplanar. The carton 10 of the present invention therefore provides a significant dual function of great advantage to a retailer. A display carton can be provided which may also be used by the user to carry the goods away from the retail establishment. Furthermore, the respective contents of the two compartments 12 and 14 are not displayed when the carton 10 is in its carrying position as shown in FIG. 1. Also, inasmuch as the display window is often the weakest portion of any typical display carton, the carton 10 of FIGS. 1 and 2 is particularly adapted to carrying inasmuch as the display windows 22 and 24 are not exposed on the exterior of the carton 10 when the carton 10 is in its carrying configuration as shown in FIG. 1. Therefore there is less likelihood that contents could rip the transparent coverings 23 and 25 and fall from the carton 10. This allows product to be shipped from a warehouse in the display carton in which it is ultimately be sold, which display carton may also be used as a carrying device by the consumer having bought the product, thus avoiding the use of additional packaging in these various steps.

In order to further fix the carton 10 in its carrying configuration as shown in FIG. 1, the tuck tab 72 or 74 of one or the other of the compartments 12 and 14 could be inserted into the interior of the other of the compartments 12 or 14 adjacent to the other of the tuck tabs 72 and 74 to aid in keeping the display panels 28 and 30 pressed together. This would aid in the stability of the carton 10 when in its carrying configuration so that it is suitable for carrying heavier loads in the compartments 12 and 14.

It is understood that the present invention is not limited to the particular construction and arrangement of parts illustrated and disclosed herein, but embraces all such modified forms thereof as come within the scope of the following claims.

I claim:

1. A display carton comprising:

first and second display panels (28, 30) hinged together by a common scoreline (20), each of the display panels (28, 30) having a display window opening (22, 24) cut therein;

a top panel (36, 38) joined to each of the display panels (28, 30);

a side panel (56, 58) joined to each of the top panels (36, 38);

a bottom panel (80, 82) joined to each of the side panels (56, 58), each of the bottom panels (80, 82) also joined to the respective display panel (28, 30) thereby defining a first compartment (12) by a one of the display panels (28), the top panels (36), the side panels (56) and the bottom panels (80), and a second compartment (14) by the other of the display panels (30), the top panels (38), the side panels (58), and the bottom panels (82); the first and second compartments (12, 14) being joined hingedly together by the scoreline (20) joining the display panels (28, 30) together opposite from the top panels (36, 38), the compartments (12, 14) being pivotable relative to each other along the scoreline (20) between a display position, in which the display panels (28, 30) are visible, and a carrying position, in which the display panels (28, 30) are held in abutting relation; and a pair of handles (16, 18) each of which is attached by a scoreline (40, 42) to the top panel of a respective one of the compartments so that the carton may be carried suspended from the handles when the compartments (12, 14) are pivoted to the carrying position and so that when the carton is carried suspended from the handles in the carrying position, the display panels (28, 30) are held pressed together, by the hinge (20) therebetween on one side and by the paid of handles (16, 18) on the other side thereof, to conceal the contents of the carton and to prevent the contents of the compartments from protruding through the window opening (22, 24) in each of the display panels.

2. A display carton as claimed in claim 1 wherein a glue flap (96, 98) is attached to each of the bottom panels (80, 82) and wherein the glue flap (98) of the second compartment (14) is adhered to the display panel (28) of the first compartment (12) while the glue flap (96) of the first compartment (12) is secured to the bottom panel (82) of the second compartment (14).

3. A display carton as claimed in claim 1 wherein a scoreline (40, 42) attaches each of the handles (16, 18) to the respective top panels (36, 38) with each of said scorelines (40, 42) being co-linear with scorelines (32, 34) joining the top panels (36, 38) to the respective display panels (28, 30).

4. A display carton as claimed in claim 1 wherein an end flap (64, 66) is provided attached to each end of each of the side panels (56, 58), the end flaps (64, 66) being foldable to close the ends of the two compartments (12, 14).

5. A display carton as claimed in claim 1 wherein a transparent window sheet (23, 25) is provided over each of the display window openings (22, 24).

6. A paperboard blank for a display carton comprising:

first and second display panels (28, 30) attached by a common scoreline (20), each of the display panels (28, 30) having a display window opening (22, 24) cut therein;

a top panel (36, 38) joined to each of the display panels (28, 30) by a respective scoreline (32, 34);

a side panel (56, 58) joined to each of the top panels (36, 38);

a bottom panel (80, 82) joined to each of the side panels (56, 58), each of the bottom panels (80, 82) also being adapted to being joined to a respective one of the display panels (28, 30) to thereby define a first compartment (12) from a one of the display panels (28), the top panels (36), the side panels (56) and the bottom panels (80), and a second compartment (14) from the other of the display panels (30), the top panels (38), the side panels (58) and the bottom panels (82) to form two compartments (12, 14) hinged together by the scoreline (20) joining the display panels (28, 30) together; and a pair of handles (16, 18) each cut from the area of the respective display opening in a respective one of the display panels (28, 30), each of which is attached to the adjacent top panel (36, 38) by a respective scoreline (40, 42) co-linear with the scoreline (32, 34) joining the respective top panel (36, 38) to the adjacent display panel (28, 30), and each of which is adapted to being used to carry the carton (10) to be erected from the blank.

7. A blank as claimed in claim 6 wherein the handles are cut from the area of the display window openings (22, 24) in the display panels (28, 30).

8. A blank as claimed in claim 6 wherein glue flaps (96, 98) are provided attached to each of the bottom panels (80, 82), the glue flaps (96, 98) being adapted to being fastened to hold the carton to be erected from the blank in its erected state.

9. A blank as claimed in claim 6 wherein an end flap (64, 66) is provided attached to each end of each of the side panels (56, 58) the end flaps (64, 66) being adapted to being folded to close the ends of the two compartments (12, 14).

* * * * *